US005088709A

United States Patent [19]

Yamamoto

[11] Patent Number: 5,088,709

[45] Date of Patent: Feb. 18, 1992

[54] SORTER

[75] Inventor: Hiroshi Yamamoto, Ibaraki, Japan

[73] Assignee: Ikegami Tsushinki Co., Ltd., Tokyo, Japan

[21] Appl. No.: 600,920

[22] Filed: Oct. 22, 1990

[30] Foreign Application Priority Data

Oct. 31, 1989 [JP] Japan ..... 1-284195

[51] Int. Cl.[5] ..... B42B 2/00

[52] U.S. Cl. ..... 270/53; 270/52

[58] Field of Search ..... 270/37, 53, 58, 52; 271/292, 287, 293, 294

[56] References Cited

U.S. PATENT DOCUMENTS

| | | | |
|---|---|---|---|
| 4,376,529 | 3/1983 | George et al. . | |
| 4,605,211 | 8/1986 | Sonobe | 270/53 |
| 4,925,171 | 5/1990 | Kramer | 270/53 |
| 4,930,761 | 6/1990 | Naito | 270/53 |

FOREIGN PATENT DOCUMENTS

| | | | |
|---|---|---|---|
| 0301538 | 2/1989 | European Pat. Off. . | |
| 301596 | 2/1989 | European Pat. Off. | 270/53 |
| 2363558 | 7/1974 | Fed. Rep. of Germany . | |
| 61-287663 | 12/1986 | Japan . | |
| 48779 | 2/1989 | Japan | 270/52 |

*Primary Examiner*—Edward K. Look
*Assistant Examiner*—Therese M. Newholm
*Attorney, Agent, or Firm*—Oliff & Berridge

[57] ABSTRACT

A sorter includes a plurality of vertically movable trays which are each formed with a cut-out in one corner. The trays are each oriented so that a corner in which the cut-out is formed is lower than the other corners of the tray and formed with a rear wall a side wall which flank the cut-out. A tray shift mechanism includes groups of three Geneva wheels. These wheels are each formed with one or more recesses which can pick-up tray pins and guide the same along guide slots. The slots are formed with portions which induce both vertical and lateral displacement of one or more trays at a time. The Geneva wheel/guide slot arrangements move the trays one by one to a position wherein sheet of printed matter can be ejected thereonto and/or the cut-outs are located in the mouth of a stapler. Due to the skewed angle of the trays the ejected sheets slide under their own weight to the corners in which the cut-outs are formed.

10 Claims, 10 Drawing Sheets

SORTER

BACKGROUND OF THE INVENTION

1. Field of the Invention

The present invention relates generally to a sorting device for use with copy and printing machines and more specifically to such a sorter which includes a novel collection tray and stapler arrangement.

2. Description of the Prior Art

Sorters which include staplers are required to firstly sort and accumulate sheets of printed matter in carefully aligned stacks before fastening the same at a predetermined location such as the upper left hand corner.

Various arrangements have been proposed to accomplish the above mentioned alignment and fastening. Arrangements for aligning the sheets prior to the stapling operation have included trays which are provided with slots and movable shafts which extend normally to the tray and which are moved through the slots until such time as the shafts engage the edge of the sheets and push the same across the tray until they engage stoppers provided along one side thereof.

In connection with the stapling devices used in such arrangements, JP-A-61-287663 discloses a proposal wherein the trays above and below the one on which the sheets to be fastened are accumulated, are arranged at relatively large spacings with respect to one another so that a stapler can be moved in between the same and assume a suitable operating position with respect to the accumulated stack of sheets.

However, with the above types of alignment arrangements drawbacks are encountered in that actuators and associated mechanisms are required to move the shafts back and forth along the slots. These devices of course consume relatively large amounts of space and thus tend to undesirably increase the size complexity and attendant cost of the sorter.

Further, the above mentioned types of stapling arrangements are such as to require mechanisms which can locate the stapler at the desired position and subsequently actuate the same. In addition to this, the relatively large spaces must be provided between adjacent trays so as to facilitate the positioning of the stapler induces the problem that the overall height of the sorter is increased and cannot be readily reduced.

SUMMARY OF THE INVENTION

It is an object of the present invention to overcome the above mentioned prior art drawback and provide a sorter which is both compact and relatively inexpensive.

Another object of the present invention is to provide a stapler equipped type sorter which can quickly sort and fasten a plurality of stacks.

A further object of the present invention is to provide a stapler equipped type sorter wherein the trays on which the sheets are accumulated can be arranged at small intervals and in a manner which enables the overall height of the sorter to be reduced.

In brief, the above objects are achieved by an arrangement wherein a vertically arranged plurality of trays are each formed with a cut-out at a rear corner. The trays are each arranged so that the corner where the cut-out is formed is lower than the other corners of the same tray. The trays can be selectively shifted by a shifting mechanism to a position wherein sheets of printed matter can be ejected thereonto. The skewed orientation of the trays causes the sheets to slide under their own weight to the corners where the cut-outs are formed and accumulate in a neat stack.

The shifting mechanism includes a plurality of Geneva wheels having recesses which pick-up the pins extending from the trays and move the same along guide slots. The central portions of the slots are curved in a manner which induces the trays to sequentially undergo lateral displacement in addition to vertical movement. When the trays are laterally displaced by a maximum amount they are stopped and sheets are ejected thereonto or stack of sheets which have been accumulated thereon, are stapled by a stapler.

More specifically, the present invention comes in a sorter which features:

a plurality of vertically movable trays;

means for vertically shifting the plurality of trays and for maintaining a tray in a predetermined position in which sheets can be received thereon, said shifting and maintaining means including a pair of Geneva wheel arrangements each having three Geneva wheels rotatably supported in a predetermined relationship with one another, each of the Geneva wheels having at least a recess formed therein;

means for ejecting a sheet onto a tray which is maintained in the predetermined position;

fastening means for fastening a stack of sheets together; and means associated with the pair of Geneva wheel arrangements for inducing a tray to undergo lateral displacement in the direction of the fastening means.

Here, the fastening means may comprise a stapler.

Each of the plurality of trays may be formed with:

a cut-out formed in one corner;

an upwardly extending rear wall which extends toward the cut-out;

a first upwardly extending side wall which extends toward the cut-out; and wherein the sorter further includes means for orienting each of the trays so that the corner in which the cut-out is formed is maintained at a level which is lower than the other corners.

Each of the trays may further comprise a second side wall which extends downwardly from a second side edge thereof, the second side wall having a height which is greater than that of the first side wall; and wherein the first and second side walls have leading and trailing ends respectively, and wherein the second side wall has horizontally extending guide pins located proximate the leading and trailing ends respectively, and wherein the first side wall has a guide pin located proximate the trailing end.

The shifting and maintaining means may comprise:

a frame in which first and second guide slots are formed, the pins which extend from the locations proximate the trailing edges of the first and second walls being slidably received in the first and second guide slots, respectively;

wherein there are three Geneva wheels associated with each of the first and second guide slots and each of the three Geneva wheels are arranged so that the recesses formed therein operatively engage the pins which are slidably received in the first and second guide slots; and drive means for selectively driving the Geneva wheels in first and second rotational directions.

The Geneva wheels which are associated with each of the guide slots may be arranged at the same heights.

Sheet ejecting means may comprise a transfer roller and a pinch roller, the transfer roller and pinch roller being rotatably supported on first transfer roller shaft and a pinch roller shaft respectively, the transfer roller shaft and the pinch roller shaft being arranged to extend laterally across the frame at a predetermined angle with respect to the horizontal.

The first and second guide slots each may extend vertically and may have central portions each having first, second and third curved portions which respectively correspond to ¼, ½ and ¼ of the peripheries of each of the first, second and third Geneva wheels.

Each of the first and second guide slots may extend vertically and may have central portions each having seven curved portions, and wherein the second Geneva wheels is formed with a recess which is deeper than the recesses formed in the first and third Geneva wheels.

Each of the Geneva wheels may be further formed with a recess diametrically opposite the recess.

In operation, the invention is such that the shifting mechanism comprised of three Geneva wheels cooperates with the shaped guide grooves in a manner which sequentially moves the plurality of trays vertically and at the same time moves one of the tray to a position laterally displaced with respect to the other trays and proximate a stapler or like fastening device. In this position, one or more sheets are ejected onto the trays and move under their own weight to the corner in which the cut-outs are formed and settle against the rear and side walls which flank the cut-out. The trays are sequentially moved up an down until the collation/accumulation of the required number of sheets is achieved. If not already in an initial tray setting, the trays are returned to the same and then sequentially moved to the laterally projected position wherein they approach the stapler and the stacks of collated sheets are fastened together. In some embodiments the stapler is moved back and forth toward the trays before the stapling operation is carried out.

With the invention as the ejected sheets move under the influence of their own weight to the corners of the trays in which the cut-outs are formed it is not necessary to provide a mechanism for neatly arranging the sheets into neat stacks prior to stapling and hence the sorter is simplified and the sorting process rendered quicker.

The sheets move and stack on one corner of the tray irrespective of the sheet size, and thus the sheets can be of mixed sizes, As the stapler is located low in the sorter and the trays are moved one by one theretoward, the height of the sorter can be notably reduced.

The above and other objects, effects, features and advantages of the present invention will become more apparent from the following description of embodiments thereof taken in conjunction with the accompanying drawings.

DETAILED DESCRIPTION OF PREFERRED EMBODIMENTS

FIGS. 1 to 6 show a first embodiment of a stapler equipped sorter according to the present invention. Firstly, before proceeding with a detailed description of the embodiments, it is deemed advantageous to consider the general layout which characterizes the sorter according to the present invention, with reference to FIGS. 1–3. In these figures, A denotes the main casing; B denotes the trays onto which sheets of printed matter and the like are collected; C and D denote the mechanisms which are used to shift the trays during the operation of the sorter and which are characterized by the use of 3 Geneva wheels; and E denotes a stapler which is movably mounted within the main casing A.

Figure 1:
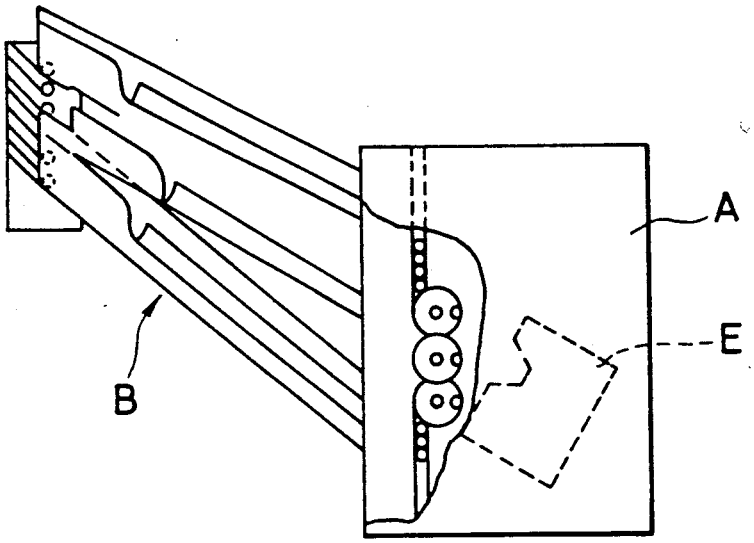
FIGS. 1 to 3 are simplified views showing the outline of a sorter according to a first embodiment of the present invention as seen in side elevation, front elevation and plan, respectively.
Figure 2:
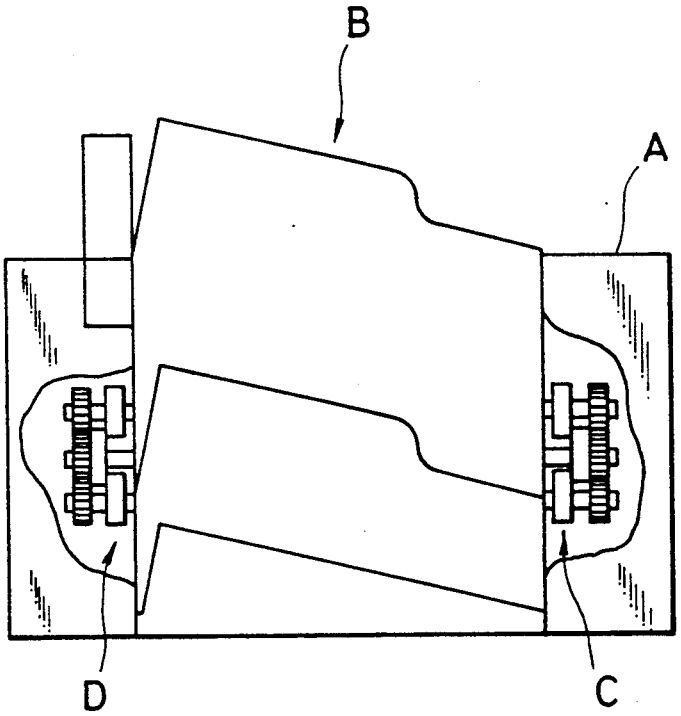
Figure 3:
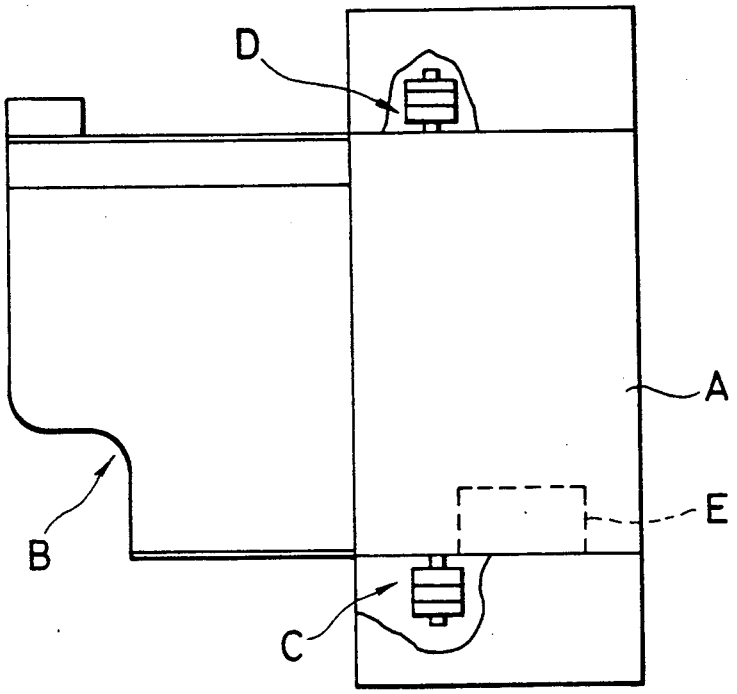
Figure 4:
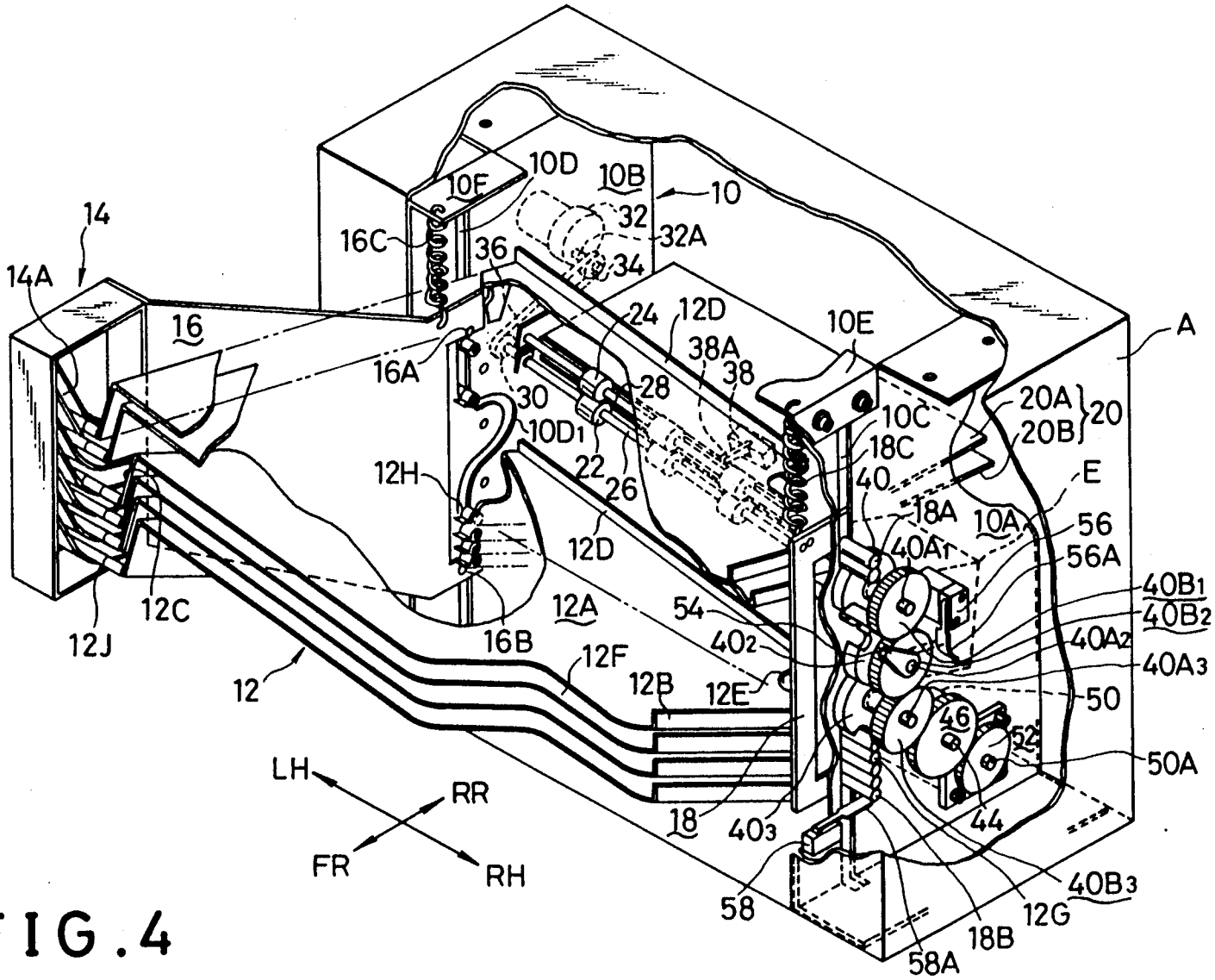
FIG. 4 is a perspective view showing the manner in which the various working components which characterize the construction of the first embodiment, are arranged with respect to one another.
Figure 5:
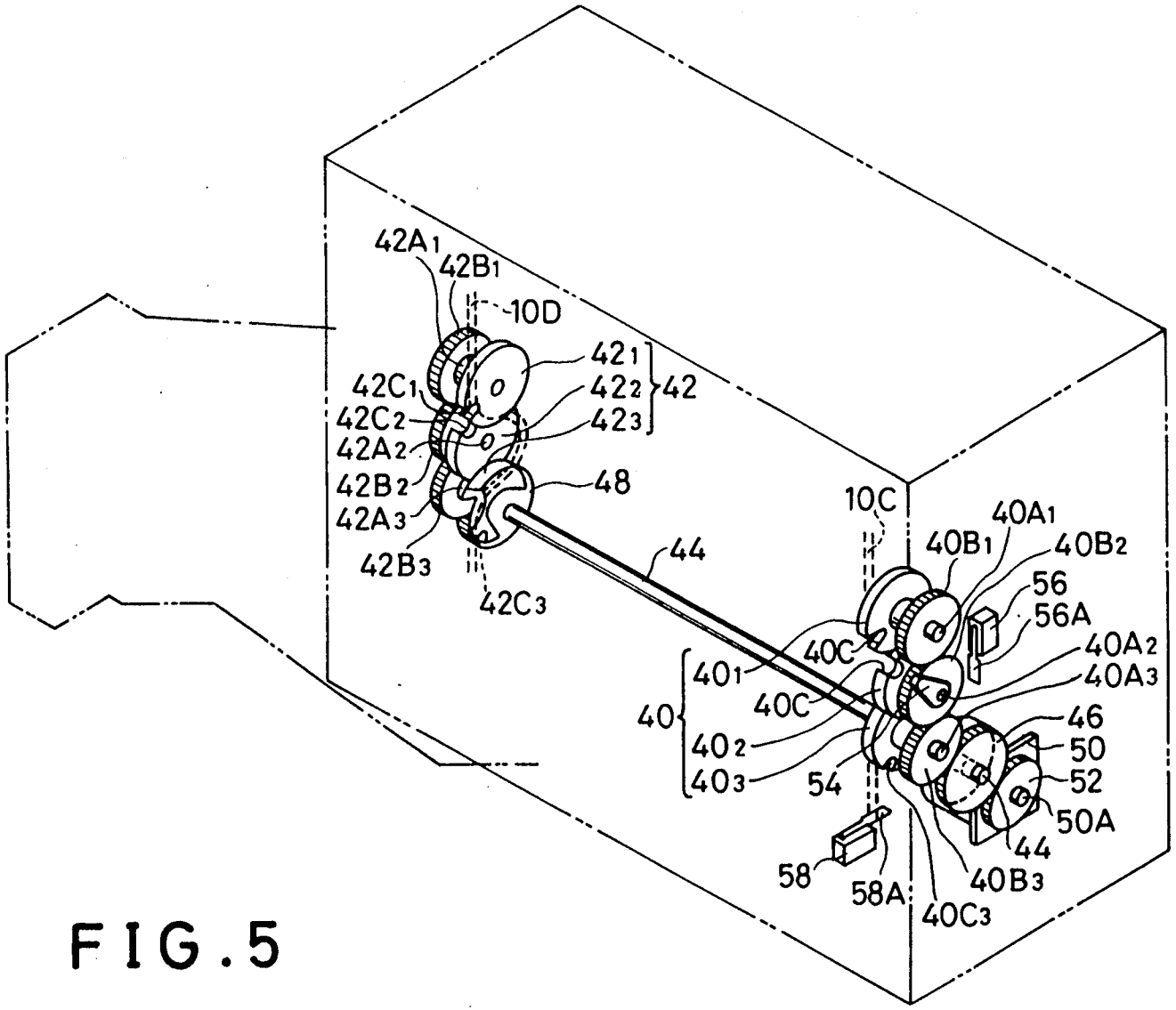
FIG. 5 is a perspective view showing details of a Geneva wheel and guide slot arrangement of a tray shift mechanism which characterizes the present invention.
Figure 6:
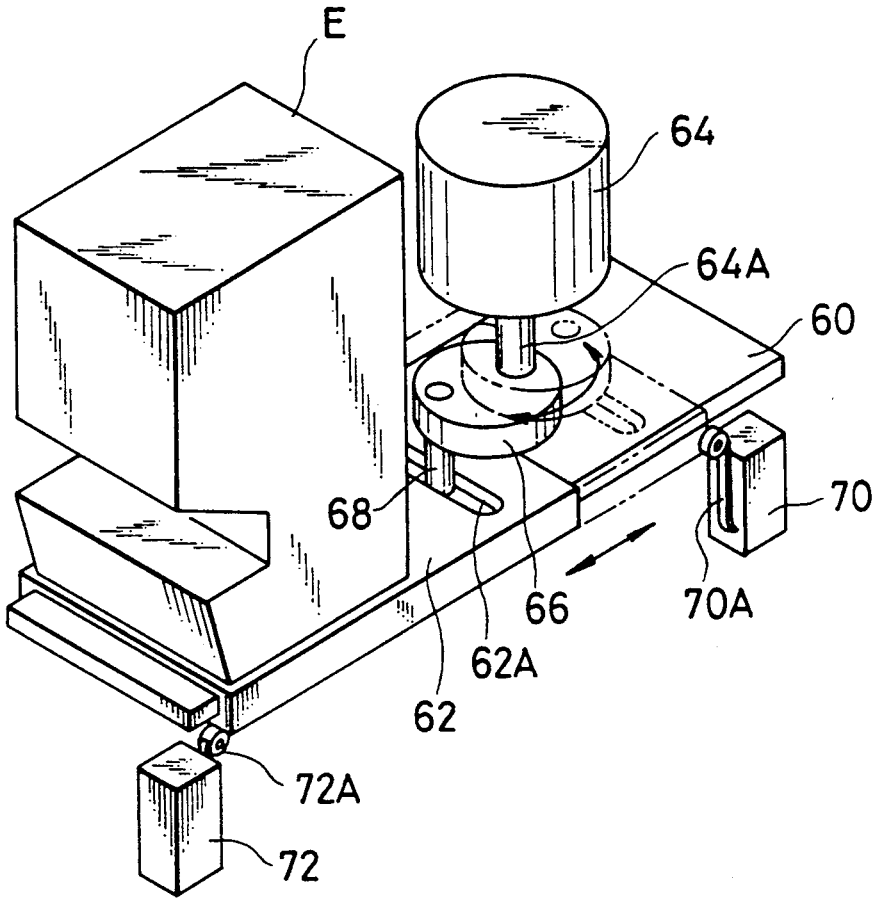
FIG. 6 is a perspective view showing the mechanism used in the first and second embodiments of the present invention to move a stapler back and forth within the sorter.

FIG. 4 shows in perspective view, details of a first embodiment of the present invention. In this view the arrows FR, RR, RH and LH respectively denote the front, rear right, and left of the sorter.

The main casing A includes a main frame 10 which comprises a right hand side frame 10A and a left side frame 10B. The side frames 10A, 10B are formed with essentially vertical extending guide slots 10C and 10D, respectively. The mid portions of these guide slots are formed with curved non-linear portions $\mathbf{10C_1}$ and $\mathbf{10D_1}$. As shown, these portions have a curvature selected in accordance with radius of Geneva wheels which will be discussed in more detail later (see FIG. 4 wherein guide slot 10D1 is clearly visible).

In this figure the numeral 12 is used to denote the trays B. A plurality of trays $\mathbf{12_1}$–12n are arranged in vertical movable array. Each of the trays are constructed in a manner to have a lower wall or base 12A, and integral vertically extending walls 12B, 12C and 12D. The walls 12B and 12D project up normally from the right and rear edges of the lower wall 12A while the side wall 12C projects vertically downwardly from the left edge 12A. The side wall 12C has a greater vertical dimension than the side wall 12B.

As the trays 12 are formed with the side walls 12B and 12C, they exhibit an increased structural rigidity which allows for the thickness of the same to be reduced.

The right rear corner of each tray is formed with a cut-out 12E which permits the stapler to be moved into an operative position with respect to the sheets which are accumulated thereon.

The front right corner of each of the trays is formed with a cut-out 12F which facilitates manual removal of the sheets.

The side walls 12B and 12C are formed with horizontal tray pins 12G and 12H which are slidably received in the previously mentioned guide slots 10D and 10C.

A horizontally extending tray pin 12J is formed the forward lower corner of each of the side walls 12C. These pins 12J are arranged to be received in a front guide member 14.

In this embodiment the front guide member 14 is formed with a plurality of guide grooves 14A ($14A_1$-$14A_n$) corresponding in number to the n number of trays 12.

Tray pins $12H_1$-12Hn which are provided on the left hand side of the trays 12 are accommodated in the guide slot 10C between guide pins 16A and 16B which are formed on a vertically movable left carrier side plate 16. The front guide member is fixedly connected to a forward end of the left carrier side plate 16 so as to be vertically movable therewith.

On the other hand, a vertically movable right carrier side plate 18 is disposed on the right side of the device and provided with guide pins 18A and 18B. The guide pins 18A and 18B are received in the guide slot 10D at locations above and below the tray pins 12G ($12G_1$-12Gn).

The carrier side plates 16, 18 are each resiliently connected to the side frames 10B, 10A by way of hanger brackets 10F, 10E and tension springs 16C and 18C.

SHEET TRANSFER MECHANISM

The sheet transfer mechanism utilized in this embodiment comprises laterally extending guide plates 20A and 20B which are fixedly connected with the main frame 10, and arranged one above the other at a predetermined spacing in a manner to define an incoming sheet transfer guide 20. This transfer guide 20 has a inlet which is positioned in a manner to receive sheets from a non-illustrated copy or printing machine, and an outlet adjacent which a transfer roller 22 and a corresponding pinch roller 24 are disposed. The transfer roller 22 and the pinch roller 24 are rotatably supported on the right side frame 10A and the left side frame 10B, by way of shafts 26 and 28, respectively. The shafts 26, 28 are arranged at a predetermined inclination with respect to the horizontal. The trays 12 are also arranged at an angle and thus enables the overall height of the main casing to be reduced. The transfer roller shaft 26 has a pulley 30 fixedly connected thereto. A motor 32 which is mounted on left side frame 10B, has an output shaft 32A on which a pulley 34 is mounted. A drive belt 36 establishes a drive connection between the pulleys 30, 34.

A sheet sensor 38 is mounted on the lower side of the guide plate 20B. This sensor 38 includes a detection lever 38A which is arranged to project into the transfer guide 20.

TRAY SHIFT AND MAINTAIN MECHANISM

Two Geneva wheel arrangements generally denoted by the numerals 40, 42 are rotatably mounted on the side frames 10A and 10B, respectively.

The Geneva wheel arrangement 40 comprises: three Geneva wheels $40_1$, $40_2$ and $40_3$ and three corresponding gears $40B_1$, $40B_2$ and $40B_3$ which are mounted on shafts $40A_1$, $40A_2$ and $40A_3$ respectively. The three gears $40B_1$, $40B_2$ and $40B_3$ are arranged to be in constant mesh with one another while the Geneva wheels are arranged in very close proximity to one another and so that the intermediate wheel $40_2$ is offset with respect to the first and third ones $40_1$, $40_3$ and located so that a partial peripheral overlap occurs. The gears have a diameter which is smaller than that of the corresponding Geneva wheels.

Each of the Geneva wheels is formed with a single recess 40C (viz., $40C_1$, $40C_2$ and $40C_3$). These recesses are dimensioned in a manner to be able to pick-up and hold a tray pin 12G. The Geneva wheels 40 are arranged with respect to one another so that, due to the mutually reversed rotation induced by the gears 40B, the recesses 40C assume the positions indicated in FIGS. 7(A) to 7(E). Viz., as will be appreciated, due to the manner in which the gears 40B mesh with one another, the center Geneva wheel $40_2$ will rotate in a rotational direction which is opposite of that in which the first and third wheels $40_1$, $40_3$ rotate.

The Geneva wheel arrangement 42 is essentially the same as the one described immediately above and accordingly a redundant description of the same will be omitted for brevity.

A shaft 44 extends between and is rotatably supported by the side frames 10A and 10B. Gears 46, 48 are mounted on the ends of this shaft and arranged to mesh with the gears $40B_3$ and $42B_3$. A motor 50 is mounted on the side frame 10A. A gear 52 which is mounted on the output shaft 50A of the motor 50 is arranged to be in constant mesh with gear 46. This establishes a drive connection between the motor 50 and each of the Geneva wheels.

In the instant embodiment, the two Geneva wheel arrangements 40, 42 are arranged at the same height. However, the right hand tray pins 12G are arranged at the same height as the base portion of each of the trays while the left tray pins 12H are arranged at locations which are proximate the bottom of the left side walls 12C. As a result, the trays 12 are angled (skewed) in a manner wherein the corners in which the cut-outs 12E are formed are maintained at a position which is lower than the other corners.

When the motor 50 is energized in a first rotational direction, the tray pins 12G, 12H at the rear of a tray 12 are picked up by the Geneva wheel arrangements 40, 42 and moved upwardly. This initiates a fan-like spreading of the trays.

It should be noted that a cam 54 is connected to the second shaft $40A_2$ on which Geneva wheel $40_2$ and gear $40B_2$ are mounted. This cam 54 is arranged to engage a lever 56A of a switch 56 which is mounted on the side frame 10A, in a manner which triggers the switch and marks a position in which the rotation of the Geneva wheel arrangements 40, 42 should be stopped.

A lower limit switch 58 is mounted on the side frame 10A proximate the lower end of the guide slot 10C. This switch 58 is provided with a lever 58A which is arranged to be engaged by the guide pin 18B in a manner which indicates the situation wherein the tray pins $12G_1$, $12H_1$ of the uppermost tray $12_1$ are received in the recesses $40C_2$, $42C_2$ of the Geneva wheels $40_2$ and $42_2$, respectively.

TRAY SHIFT AND DRAWING MECHANISM

As shown in FIGS. 7(A) to 7(E) the center portion of the guide slots 10C, 10D are formed with curved non-linear portions $10C_1$ and $10D_1$. For the sake of simplicity, a discussion of the arrangement mounted on the right side plate 10A will be given although it is to be understood that corresponding operations take place on both sides.

The curved portion $10C_1$ is comprised of three curves. The upper curve corresponds to ¼ of the circumference of the upper Geneva wheel $40_1$; the second curve to ½ of the circumference of the second Geneva wheel $40_2$; and the third curve to ¼ of the third Geneva wheel $40_3$.

Figures 7A, 7B, 7C, 7D, 7E:
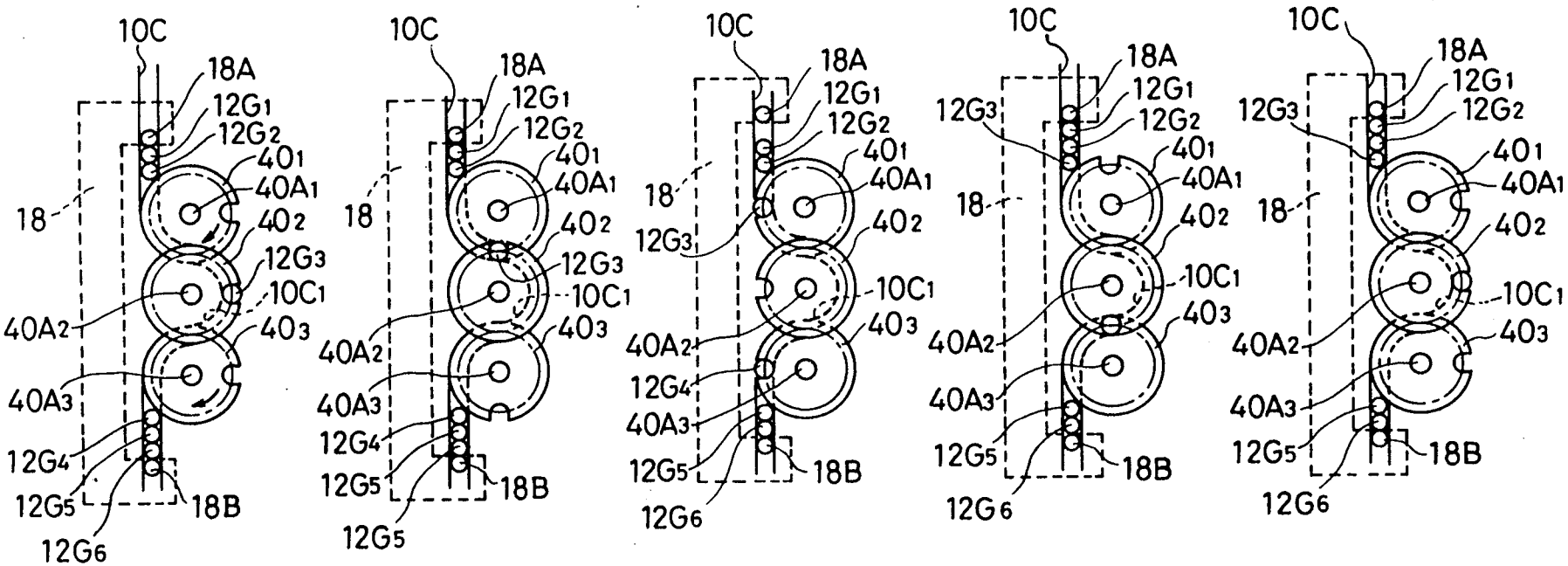
FIGS. 7(A) to 7(E) are views showing the operation of the tray shift mechanism which characterizes the first embodiment of the present invention.

As will be apparent, during the operation of this arrangement the trays will be induced to undergo a maximum lateral displacement which is approximately equal to the diameter of the Geneva wheels at a time when the pins associated therewith enter the recess formed in the center Geneva wheel $40_2$ and the wheels assume the rotational positions illustrated in FIGS. 7(A) and 7(E).

STAPLER

A base plate 60 (see FIG. 6) is fixed to the side frame 10A. A slider 62 on which the stapler E is supported, is reciprocatively mounted on the base plate 60. A motor 64 mounted on side frame 10A. A crank wheel 66 is eccentrically mounted on an output shaft 64A of the motor 64. A pin 68 which extends from the periphery of the crank wheel 66 extends through a laterally extending slot 62A formed in the slider 62.

In the instant embodiment the stapler E may take the form of an electrically operated O.M.E. Standard Model #69031 or O.M.E Wide Gap Model #69035 manufactured by the Swingline Company of the United States.

A position sensor switches 70, 72 are mounted adjacent the base plate 60, respectively. The switches 70, 72 are provided with levers 70A, 72A which are arranged to be engaged by the slider 62 when it assumes a fully retracted position such as indicated in phantom and when it assumes an advanced position such as indicated in bold line.

OPERATION

A control unit (not shown) which includes a microprocessor, receives data from the associated host copy or printing machine indicative the number of stacks the sheets must be divided into, the number of sheets for each stack, etc. In response to this information the motor 50 is energized to rotate in a first rotational direction. This induces the Geneva wheel arrangements 40, 42 to pick up the tray pins 12G, 12H of the trays and induce the trays 12 to undergo a downward shift. When the uppermost tray $12_1$ reaches a position wherein it can receive sheets from the sheet transfer guide 20 (viz., assumes what shall be referred to as an initial tray setting) the tray pins $12G_1$ and $12H_1$ of the upper tray $12_1$ are received in the recesses $40C_2$ and $42C_2$ of the middle Geneva wheels $40_2$, $42_2$ and the carrier side plate 18 is lowered to the point whereat the lower limit switch 58 is triggered by the guide pin 18B engaging the lever 58A. The rotation of motor 50 is stopped in response to the triggering of the lower limit switch 58.

A counter included in the control unit also responds to the triggering of the lower limit switch 58 and clears a counter included therein and resets the same to zero.

When a sheet of copied material and the like are supplied into the transfer guide 20, motor 32 is energized in response to the operation of the sheet sensor 38. This drives the transfer rollers 22 and 24 and induces the sheet to be ejected onto the uppermost tray. The ejected sheet moves under its own weight until it rests against the right and rear walls 12B, 12D of the tray in question.

The control unit responds to the output of the sheet sensor 38 indicating that the sheet has passed through the transfer guide 20 and energizes the motor 50 in a manner wherein it rotates in a second rotational direction. This induces the Geneva wheel arrangements to shift the top tray upwardly.

TRAY SHIFTING

Figure 8:
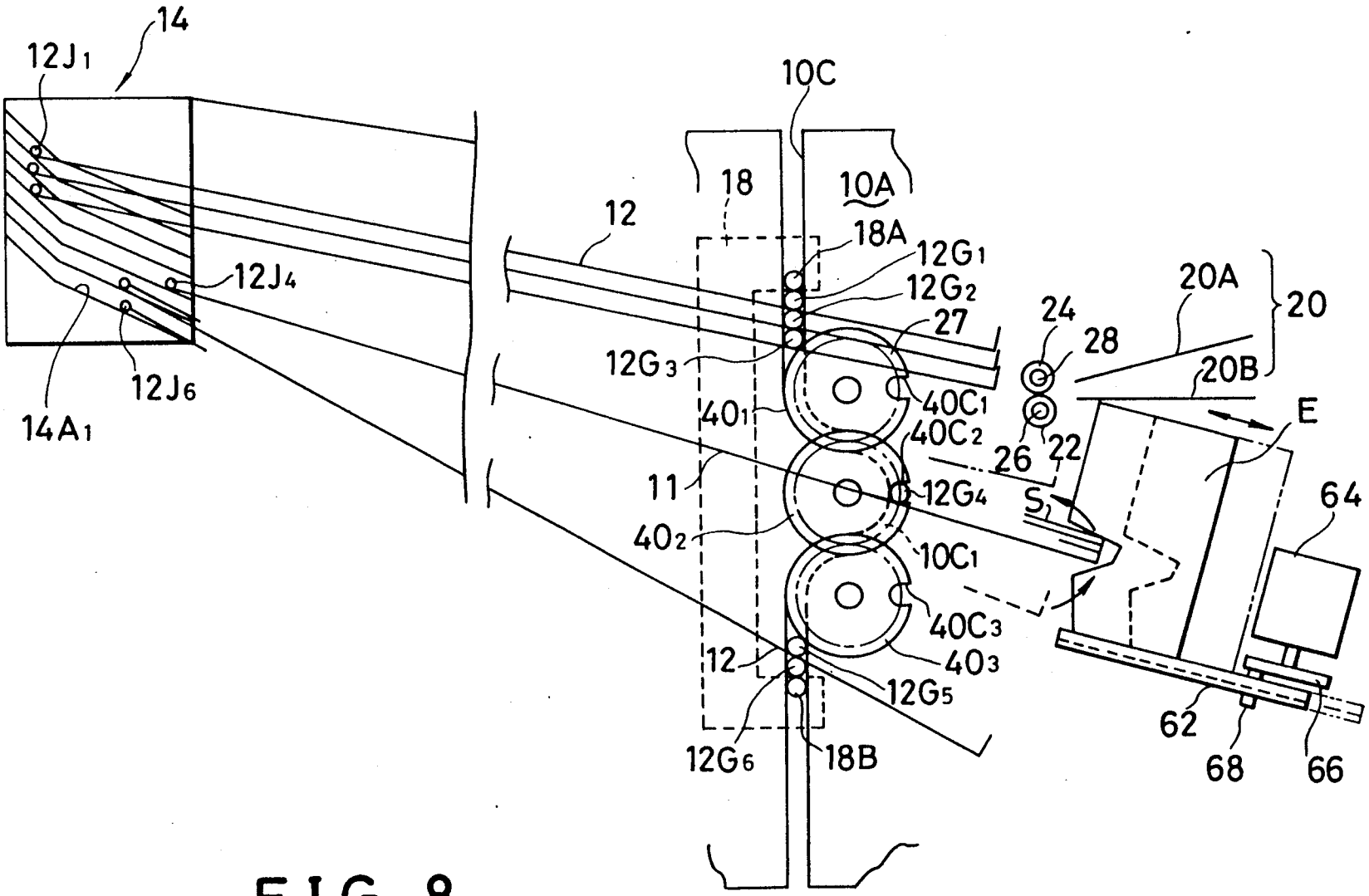
FIG. 8 is a schematic side view showing the relationship assumed between the trays and the stapler during a stapling operation of the first embodiment.

FIGS. 7 and 8 show details of the above mentioned tray shifting operation. FIG. 7(A) shows the situation wherein the third tray $12_3$ is located in a position to have sheets ejected thereonto. At this time the tray pins $12G_2$ ($12H_2$) (only $12G_2$ is shown) of the second tray $12_2$ are disposed against the outer peripheral surfaces of the top Geneva wheels $40_1$ ($42_1$) while the tray pins of the third tray $12_3$ are received in the recesses $40C_2$ ($42C_2$) of the intermediate Geneva wheels $40_2$ ($42_2$). Under these conditions a relatively large gap is opened up between the inboard (rear) ends of the second and third trays $12_2$, $12_3$. It will be noted that as the tray pins of the 4th and 5th trays are resting on top of the guide pins 18B (16B) of the side frames 18 and 16, as the latter are moved upwardly each time a tray pin is moved to the top of the Geneva wheel arrangements, the tray pins $12G_4$ ($12H_4$) of the fourth tray are pressed into contact with the peripheries of the third or lower Geneva wheels $40_3$ ($42_3$).

As will be noted, under these conditions all of the recesses 40C (42C) formed in the Geneva wheels are located at in the same rotational positions (e.g. at 3:00). As the wheels rotate from the positions shown in FIG. 7(A) to that shown in FIG. 7(B) the recesses $40C_1$, $40C_2$ in the first and second Geneva wheels rotate to positions wherein they overlap one another and the tray pins $12G_3$ ($12H_3$) are transferred from the recesses $40C_2$ ($42C_2$) in the intermediate Geneva wheels to those $40C_1$ ($42C_1$) in the upper ones.

After the wheels have rotated 90 degrees from the positions shown in FIG. 7B, the tray pins of the third tray $12_3$ have reached the position illustrated in FIG. 7(C), while the tray pins of the fourth tray $12_4$ have been picked up in the recesses $40C_3$ ($42C_3$) and carried along the guide slots 10C (10D) to the 9:00 positions.

Following a further 90 degree rotation, the wheels assume the positions shown in FIG. 7(D) wherein the tray pins $12G_3$ ($12H_3$) of third tray have left the recesses $40C_1$ ($42C_1$) are resting on the peripheries of the Geneva wheels $40_1$ ($42_1$) and the tray pins $12G_4$ ($12H_4$) are being transferred from the recesses $40C_3$ ($42C_3$) in the third Geneva wheels to those in the intermediate ones.

Upon the Geneva wheels assuming the positions shown in FIG. 7(E) (which are the same as those shown in FIG. 7(A)) one full upshift operation has been completed and the trays assume the condition illustrated in FIG. 8.

As will be appreciated as each tray is upshifted, it also undergoes a lateral displacement wherein it is projected rearwardly to a degree wherein sheet ejection is facilitated.

As each tray is shifted upwardly, the tray pins 12G, 12H are transferred along the guide slots 10C, 10D and induce the guide pins of the side carrier plates 16, 18 to also move upwardly. This induces the situation wherein the tray pins 12J which are received in the grooves 14A of the guide member 14, are also vertically displaced but in a manner wherein the necessary inclination of the trays 12 on which sheets of printed matter have been ejected, is maintained.

It will be noted that the front side of the groove 14A is steeper than the rear side thereof so that a large gap formed between trays is obtained to facilitate easy sheet ejection.

After the trays have shifted up and down enough times to permit the collation of the sheets to be completed, the trays 12 are all downshifted to the above mentioned initial tray setting. Upon this condition being achieved the lower limit switch 58 is triggered and the counter in the control unit is reset to zero.

STAPLING

It will be remembered that each time the Geneva wheel arrangements complete a rotation, the cam 54 triggers switch 56 at a timing when the trays have undergone a maximum amount of lateral displacement toward the stapler E, and are located in the condition illustrated in FIG. 8. Each time a tray assumes this position the shifting is stopped and the control unit energizes motor 64 to rotate and causes slider 62 to slide from the position in which switch 70 is triggered to one shown in bold line in FIGS. 6 and 8. In this position a lever 72A of a stapler position detection switch 72 is engaged by the leading end of the slider 62 and the rotation of the motor 64 is stopped.

Under these conditions the stapler E is positioned over the cut-out 12E of the extended tray and stack of sheets which have been collected thereon. The stapler E is actuated to fasten the sheets in response to the output of the position detection switch 72.

After the stapling operation, the motor 64 is re-energized and the stapler is moved back toward the position illustrated in broken line in FIG. 8. Upon reaching this position, the stapler initial position sensing switch 70 is triggered, the motor 64 is stopped and the next tray shifting operation is resumed to bring the next tray to a position suitable for stapling of the sheet thereon.

SECOND EMBODIMENT

Figure 9:
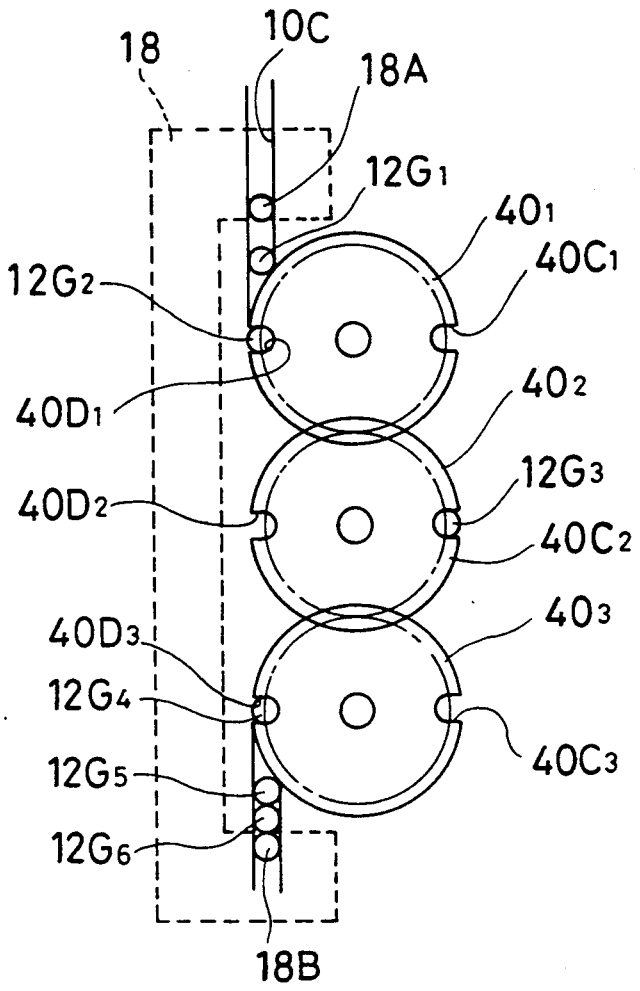
FIG. 9 is a side view showing the arrangement which characterizes a second embodiment of the present invention.

FIG. 9 shows a second embodiment of the present invention. This arrangement is directed to speeding the rate at which the trays can be shifted.

In this embodiment each of the Geneva wheels are provided with two diametrically opposed recesses. This enables the number of trays which are shifted to be basically doubled per rotational operation of the Geneva wheel arrangements.

THIRD EMBODIMENT

Figure 10:
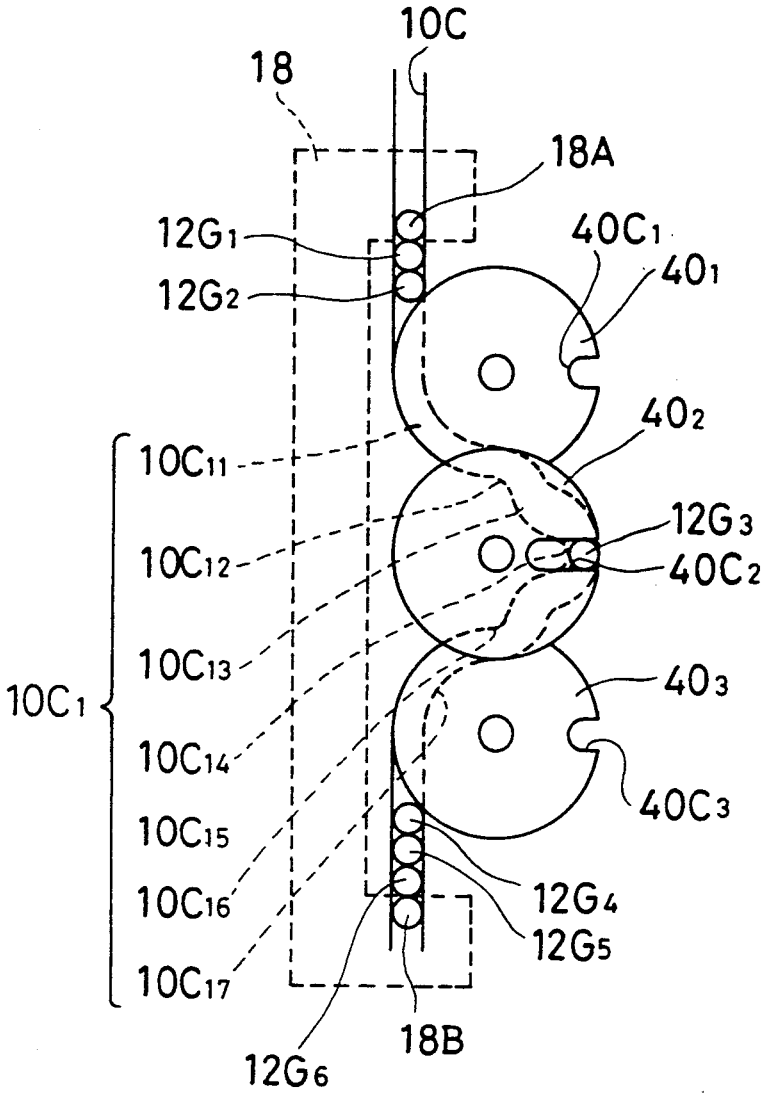
FIG. 10 is a side view showing the arrangement which characterizes a third embodiment of the present invention.

FIG. 10 shows a third embodiment of the present invention. In this arrangement the recesses $40C_2(42C_2)$ which are formed in the intermediate Geneva wheels $40_2(42_2)$ are deeper than the corresponding ones formed in the first and third wheels so that the tray pins 12G(12H) can slide therealong by a predetermined amount. In addition to this, the intermediate portions of the guide slot 10C is formed so as to have 7 curved portions $10C_{11}$, $10C_{12}$,$10C_{13}$, $10C_{14}$, $10C_{15}$, $10C_{16}$ and $10C_{17}$. The intermediate portion of guide slot 10D is formed with a corresponding number of corresponding curved portions.

Figure 11:
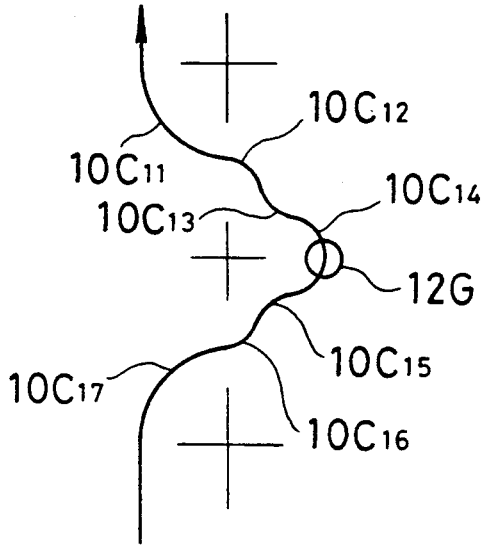
FIG. 11 shows the locus traced out by a tray pin during the operation of the sorter equipped with the third embodiment of the present invention.

These curved portions are such as to induce the tray pins 12G(12H) to each trace out a locus of the nature illustrated in FIG. 11 as the pass through the intermediate portions of the above mentioned guide slots 10C, 10D.

This construction enable the amount of lateral displacement achieved per unit vertical displacement to be locally increased, particularly as the tray approaches the position in which stapling is carried out. As a result of this movement it is possible to slip the tray into the mouth of the stapler and obviate the need to move the stapler to the tray as in the case of the previous embodiments.

This enables the amount of space which must be provided for the stapler E per se to be reduced and enables a reduction in the depth dimension of the sorter.

It will be appreciated that it is possible to install devices which enable to apply adhesive at the edges of a stack of sheets so as to fasten the same instead of a stapler.

The present invention has been described in detail with respect to preferred embodiments, and it will now be apparent from the foregoing to those skilled in the art that changes and modifications may be made without departing from the invention in its broader aspects, and it is the invention, therefore, in the appended claims to cover all such changes and modifications as fall within the true spirit of the invention.

What is claimed is:

1. A sorter comprising:

a plurality of vertically movable trays;

means for vertically shifting said plurality of trays and for maintaining a tray in a predetermined position in which sheets can be received thereon, said shifting and maintaining means including a frame in which a pair of guide slots, including first and second guide slots, each having vertical portions and a curved portion at its center, are formed and a pair of Geneva wheel arrangements each having three Geneva wheels vertically arranged and rotatably supported in a predetermined relationship with one another, each of said Geneva wheels having at least a recess formed therein;

means for ejecting a sheet onto a tray which is maintained in said predetermined position;

means associated with said pair of Geneva wheel arrangements and said first and second guide slots for inducing one of said trays to undergo lateral displacement; and fastening means for fastening a stack of sheets accumulated on said laterally displaced tray together.

2. A sorter as claimed in claim 1 wherein said fastening means comprises a stapler.

3. A sorter as claimed in claim 2 wherein each of said plurality of trays is formed with:

a cut-out formed in one corner;

an upwardly extending rear wall which extends toward said cut-out;

a first upwardly extending side wall which extends toward said cut out; and wherein said sorter further includes means for orienting each of said trays so that the corner in which said cut-out is formed is maintained at a level which is lower than the other corners.

4. A sorter as claimed in claim 3 wherein each of said trays further comprises a second side wall which extends downwardly from a second side edge thereof, said second side wall having a height which is greater than that of said first side wall; and wherein said first and second side walls have leading and trailing ends respectively, and wherein said second side wall has horizontally extending guide pins located proximate the leading and trailing ends respectively, and wherein said first side wall has a guide pin located proximate the trailing end.

5. A sorter as claimed in claim 4 wherein said pins which extend from the locations proximate the trailing edges of said first and second walls are slidably received in said first and second guide slots, respectively and each of the three Geneva wheels are arranged so that the recesses formed therein operatively engage the pins which are slidably received in said first and second guide slots; and further comprising drive means for selectively driving said Geneva wheels in first and second rotational directions.

6. A sorter as claimed in claim 5 wherein the Geneva wheels which are associated with each of said guide slots are arranged at the same heights.

7. A sorter as claimed in claim 6 wherein sheet ejecting means comprises a transfer roller and a pinch roller, said transfer roller and pinch roller being rotatably supported on first transfer roller shaft and a pinch roller shaft respectively, said transfer roller shaft and said pinch roller shaft being arranged to extend laterally across the frame at a predetermined angle with respect to the horizontal.

8. A sorter as claimed in claim 6 wherein said first and second guide slots each extend vertically and have central portions each having first, second and third curved portions which respectively correspond to $\frac{1}{4}$, $\frac{1}{2}$ and $\frac{1}{4}$ of the peripheries of each of said first, second and third Geneva wheels.

9. A sorter as claimed in claim 6 wherein each of said first and second guide slots extend vertically and have central portions each having seven curved portions, and wherein the second Geneva wheels is formed with a recess which is deeper than the recesses formed in the first and third Geneva wheels.

10. A sorter as claimed in claim 1 wherein each of said Geneva wheels is further formed with a recess diametrically opposite said recess.

* * * * *

UNITED STATES PATENT AND TRADEMARK OFFICE

CERTIFICATE OF CORRECTION

PATENT NO. : 5,088,709

DATED : February 18, 1992

INVENTOR(S) : Hiroshi YAMAMOTO and Hiroshi TOBITA

It is certified that error appears in the above-identified patent and that said Letters Patent is hereby corrected as shown below:

On the cover page, in section [75], change "Hiroshi Yamamoto, Ibaraki, Japan" to --Hiroshi Yamamoto; Hiroshi Tobita, both of Ibaraki, Japan--.

Signed and Sealed this

Twentieth Day of April, 1993

*Attest:*

MICHAEL K. KIRK

*Attesting Officer*

*Acting Commissioner of Patents and Trademarks*